US007744510B1

(12) United States Patent
Chen et al.

(10) Patent No.: US 7,744,510 B1
(45) Date of Patent: Jun. 29, 2010

(54) WAIST EXERCISING DEVICE

(76) Inventors: I-Huang Chen, No. 66, Alley 71, Lane 252, Sec. 2, Jieshou Rd., Pateh City, Taoyuan Hsien (TW); Chang-Feng Lin, 4F., No. 76, Daxin St., Yonghe City, Taipei Hsien (TW)

( * ) Notice: Subject to any disclaimer, the term of this patent is extended or adjusted under 35 U.S.C. 154(b) by 0 days.

(21) Appl. No.: 12/536,684

(22) Filed: Aug. 6, 2009

(51) Int. Cl.
*A63B 21/22* (2006.01)

(52) U.S. Cl. ..... 482/110; 482/105

(58) Field of Classification Search ..... 482/110, 482/140, 907, 45, 46, 82; 446/238, 266; 472/137; D21/662
See application file for complete search history.

(56) References Cited

U.S. PATENT DOCUMENTS

D418,562 S * 1/2000 Pravitz et al. ..... D21/684
6,077,194 A * 6/2000 Chang ..... 482/8
6,488,614 B1 * 12/2002 Chang ..... 482/110
6,719,675 B2 * 4/2004 Yu ..... 482/110
7,008,356 B2 * 3/2006 Hung ..... 482/140

* cited by examiner

*Primary Examiner*—Jerome Donnelly
(74) *Attorney, Agent, or Firm*—Alex Juris, PLLC; Tracy M Heims

(57) ABSTRACT

A waist exercising device has a waist cushion, a weight roundel and a centrifugal weight assembly. The weight roundel is mounted rotatably on the waist cushion and has a cavity defined in the weight roundel and a pivot shaft formed in the cavity. The centrifugal weight assembly is mounted in the cavity and has an arm and a weight. The arm is connected pivotally to the pivot shaft. The weight is connected to the arm and generates centrifugal force and has at least one detachable weight element. A beginner may use less weight elements and a skilled user more for tailored difficulty exercise.

11 Claims, 11 Drawing Sheets

WAIST EXERCISING DEVICE

BACKGROUND OF THE INVENTION

1. Field of the Invention

The present invention relates to an exercising device, and more particularly to a waist exercising device that has an adjustable centrifugal weight assembly so a centrifugal load of an exercise hoop may be adjusted to achieve excellent exercising effect.

2. Description of Related Art

Conventional exercise hoops are set loosely around a person's waist and rotated by the person swaying for improved muscle definition and prevent fat accumulation.

However the conventional exercise hoop has the following defects.

The exercise hoop lacks positioning functions to securely position itself on the person's waist. Therefore, beginners incapable of swaying correctly cannot stably maintain the exercise hoop on their waist and become frustrated easily.

Furthermore, due to even weight distribution of the exercise hoop, skilled users need not apply strenuous effort so cannot exercise efficiently without further adding weight to the exercise hoop.

Moreover, the exercise hoop constantly hits and rubs against the person's waist and may injure the waist.

To overcome the shortcomings, the present invention provides a waist exercising device to mitigate or obviate the aforementioned problems.

SUMMARY OF THE INVENTION

The main objective of the invention is to provide a waist exercising device that has an adjustable centrifugal weight assembly so a centrifugal load of the exercise hoop may be adjusted to achieve excellent exercising effect.

A waist exercising device in accordance with the present invention has a waist cushion, a weight roundel and a centrifugal weight assembly. The weight roundel is mounted rotatably on the waist cushion and has a cavity defined in the weight roundel and a pivot shaft formed in the cavity. The centrifugal weight assembly is mounted in the cavity and has an arm and a weight. The arm is connected pivotally to the pivot shaft. The weight is connected to the arm and generates centrifugal force and has at least one detachable weight element.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
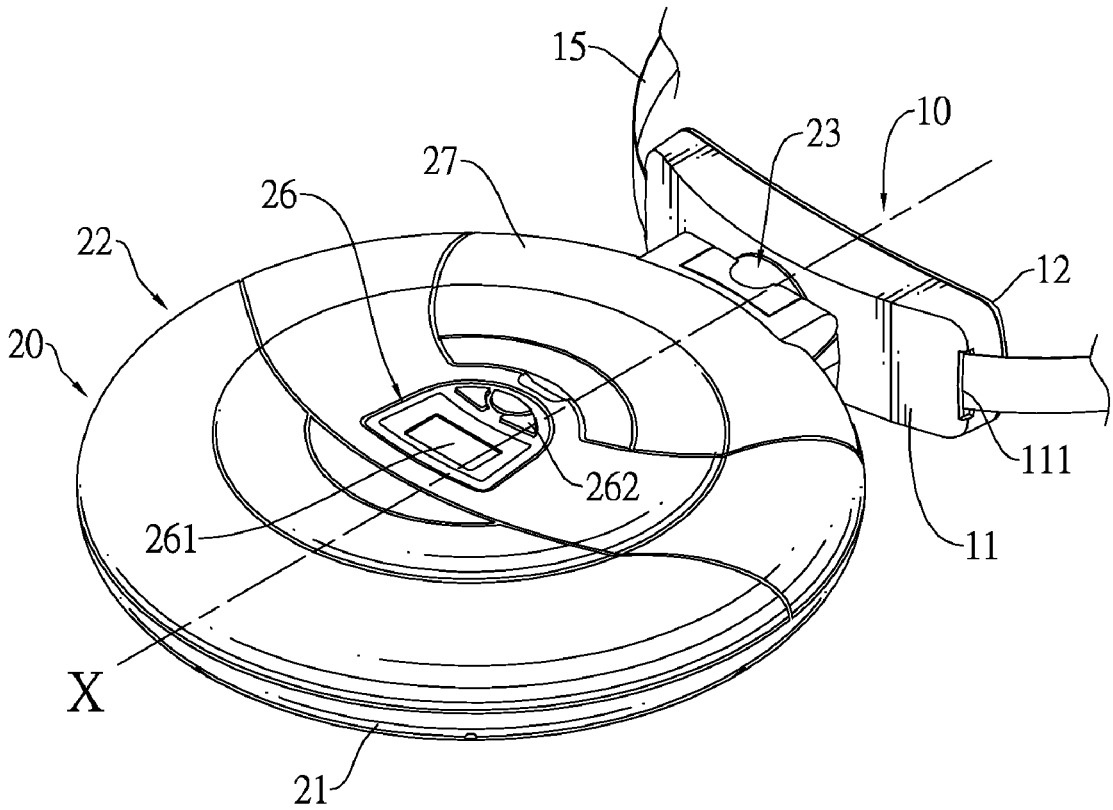
FIG. 1 is a perspective view of a waist exercising device in accordance with the present invention.
Figure 2:
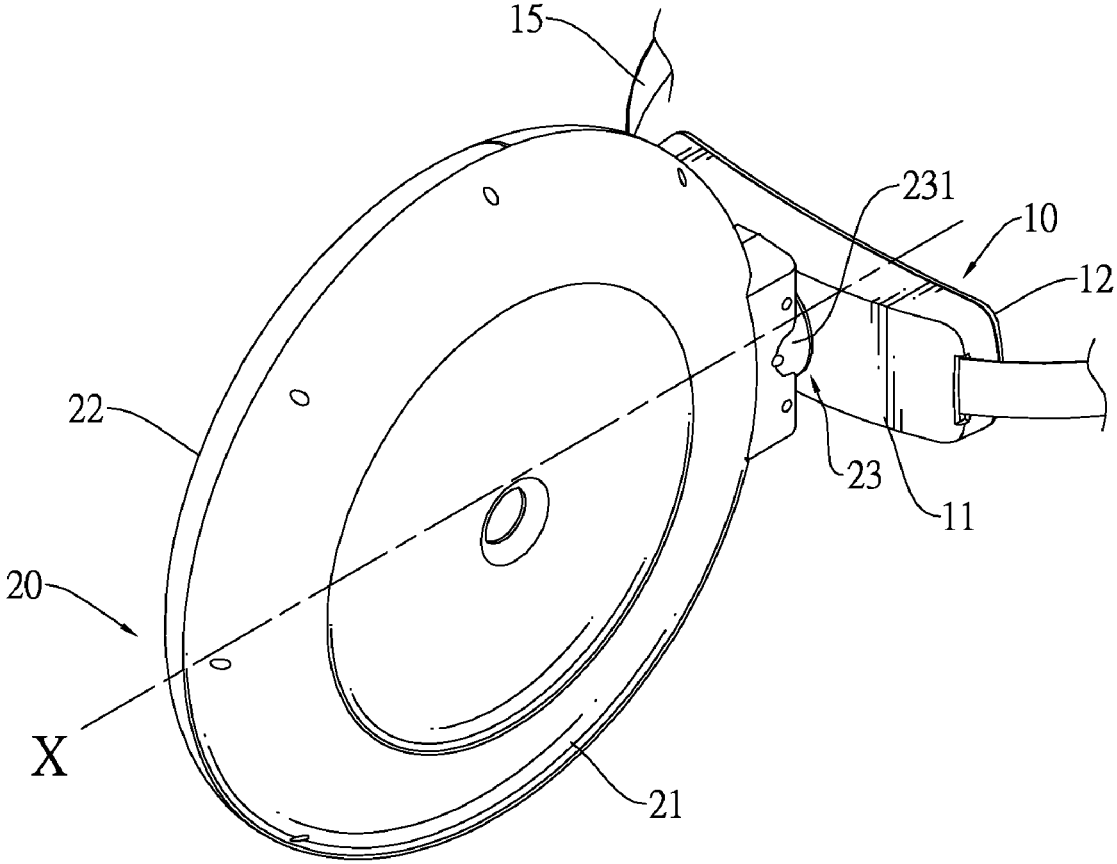
FIG. 2 is an operational perspective view of the waist exercising device in FIG. 1 showing a weight roundel rotating relative to a waist cushion on a waist belt.
Figure 3:
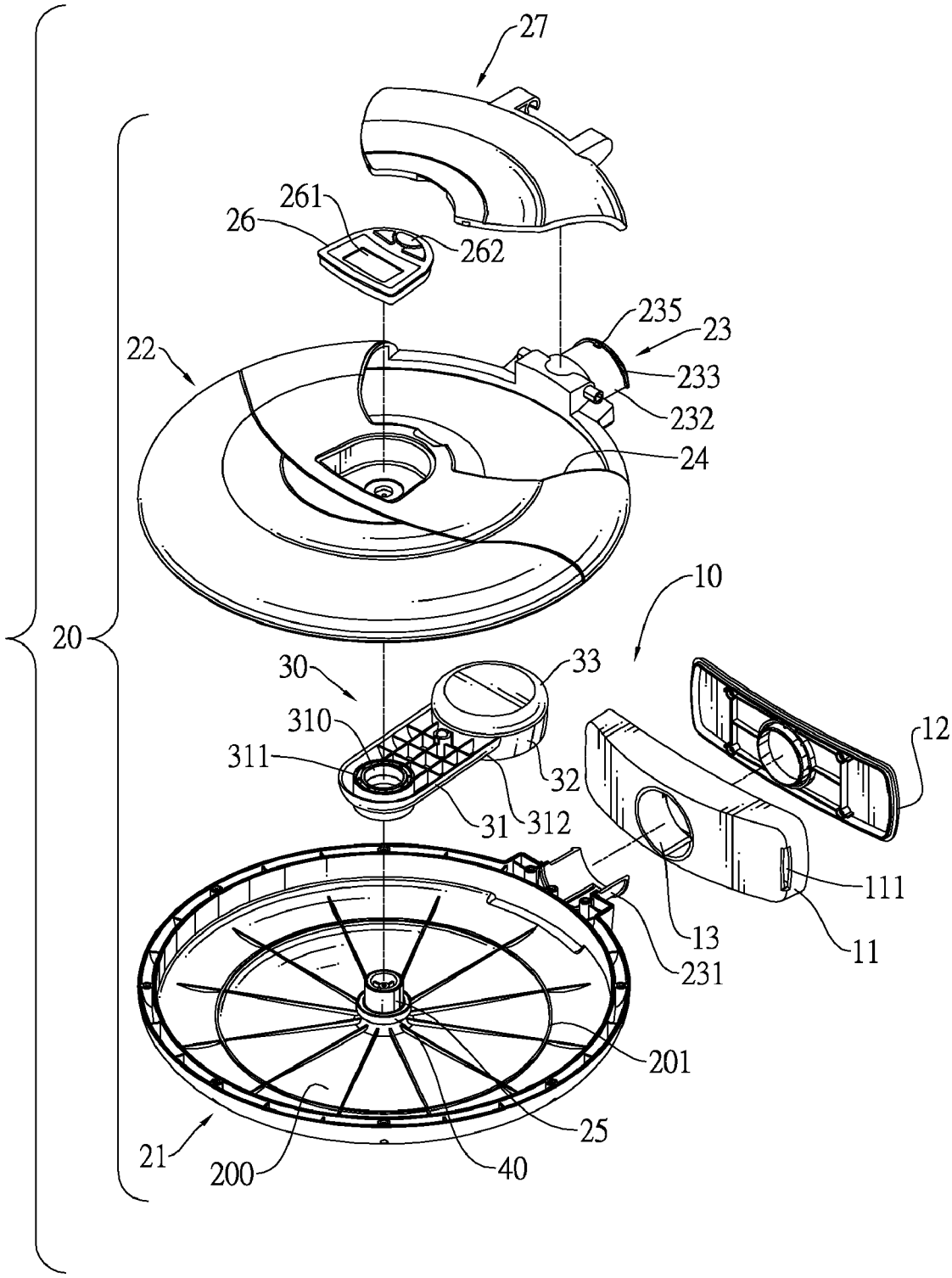
FIG. 3 is an exploded perspective view of the waist exercising device in FIG. 1.

With reference to FIGS. 1 to 3, a waist exercising device in accordance with the present invention comprises a waist cushion (10), a weight roundel (20) and a centrifugal weight assembly (30).

Figure 6:
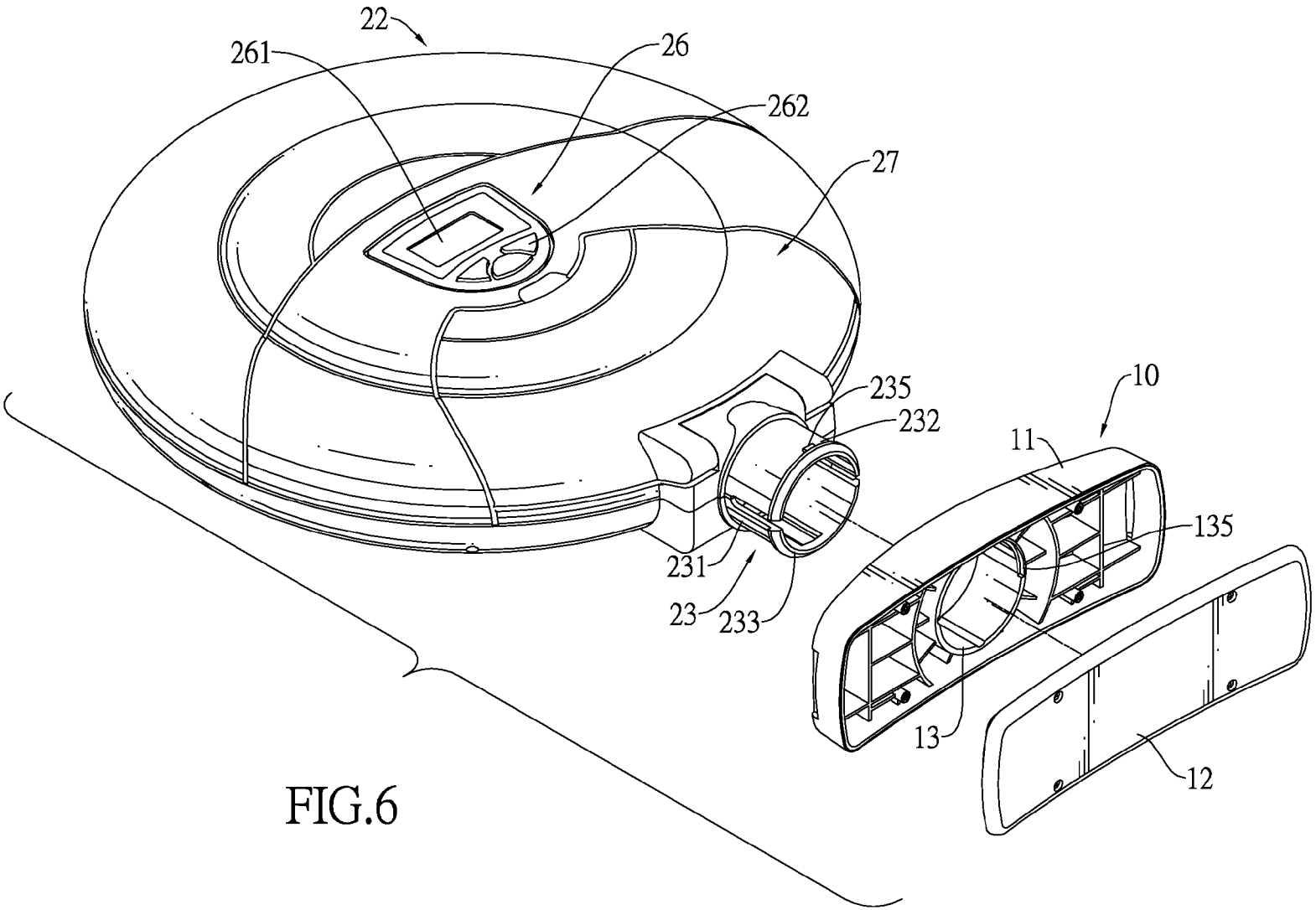
FIG. 6 is a partially exploded perspective view of the waist exercising device in FIG. 1.
Figure 7:
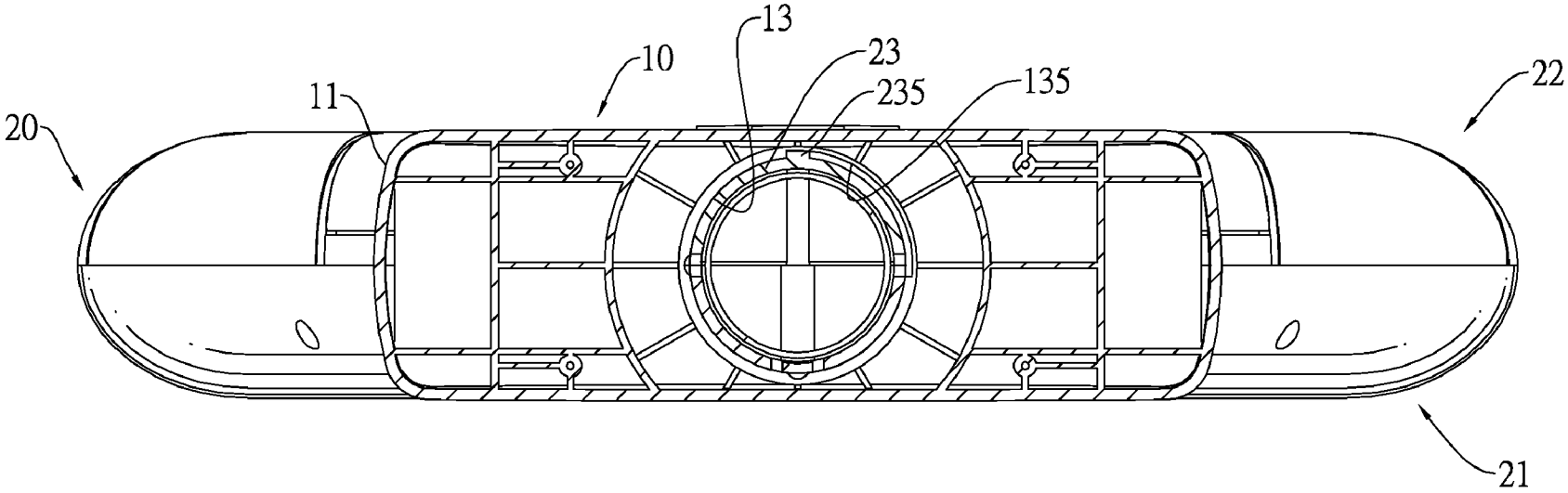
FIG. 7 is a cross sectional rear view of the waist exercising device in FIG. 1.
Figure 8:
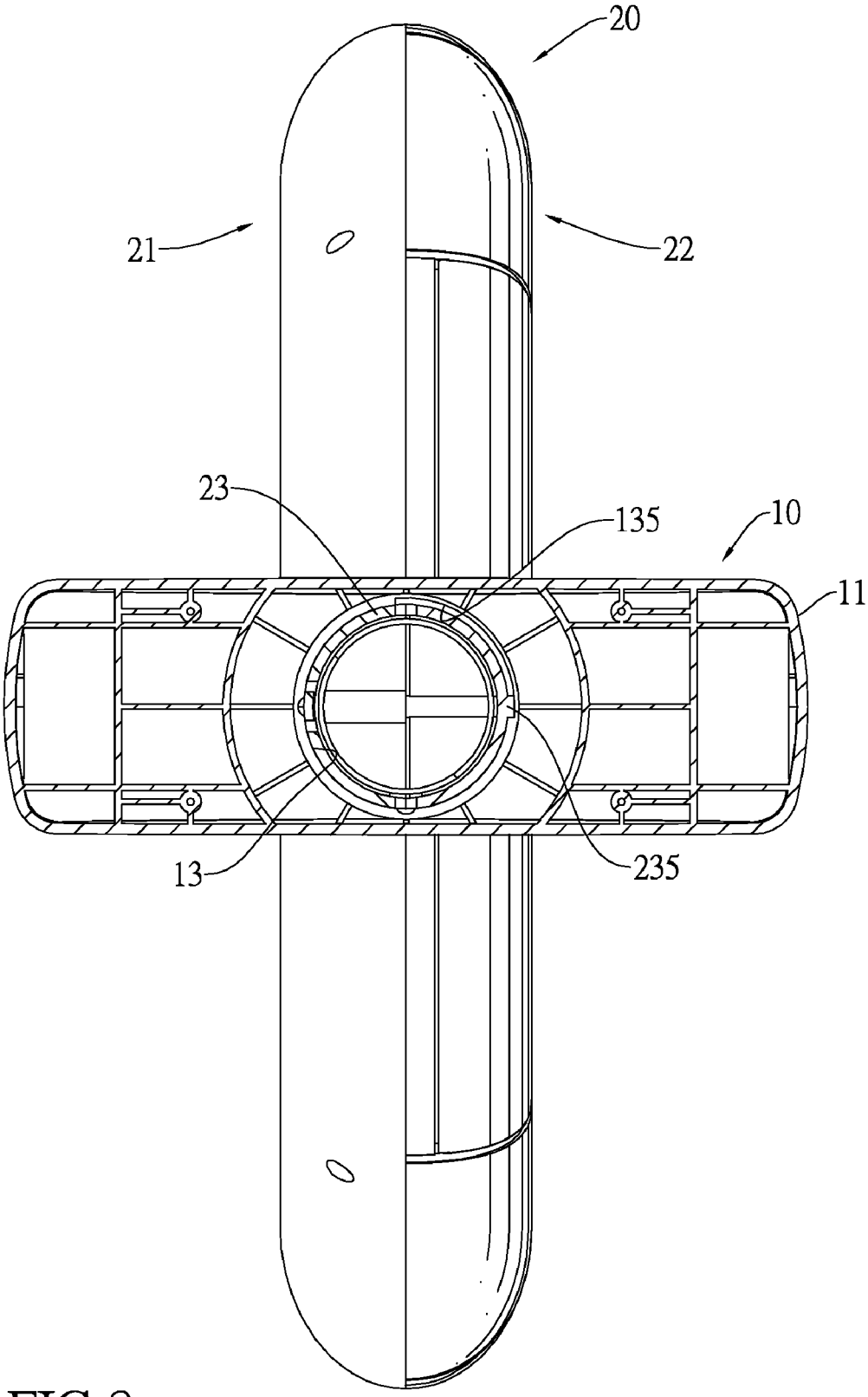
FIG. 8 is an operational cross sectional rear view of the waist exercising device in FIG. 2.

With further reference to FIGS. 6 to 8, the waist cushion (10) may be put on an abdomen of an exerciser for cushioning and comforting purposes and may have a pivot mount (11), a cushion plate (12), two mounting holes (111), a pivot hole (13) and a waist belt (15).

The cushioning plate (12) is mounted on the pivot mount (11) and may press against the abdomen.

The mounting holes (111) are defined transversely through the pivot mount (11).

The pivot hole (13) is defined through the pivot mount (11) and has an inner surface and a limiting slot (135). The limiting slot (135) is defined in the inner surface and may be a quarter of a circle.

The waist belt (15) is mounted through the mounting holes (111) and may be tightened around a waist of the exerciser.

Figure 9:
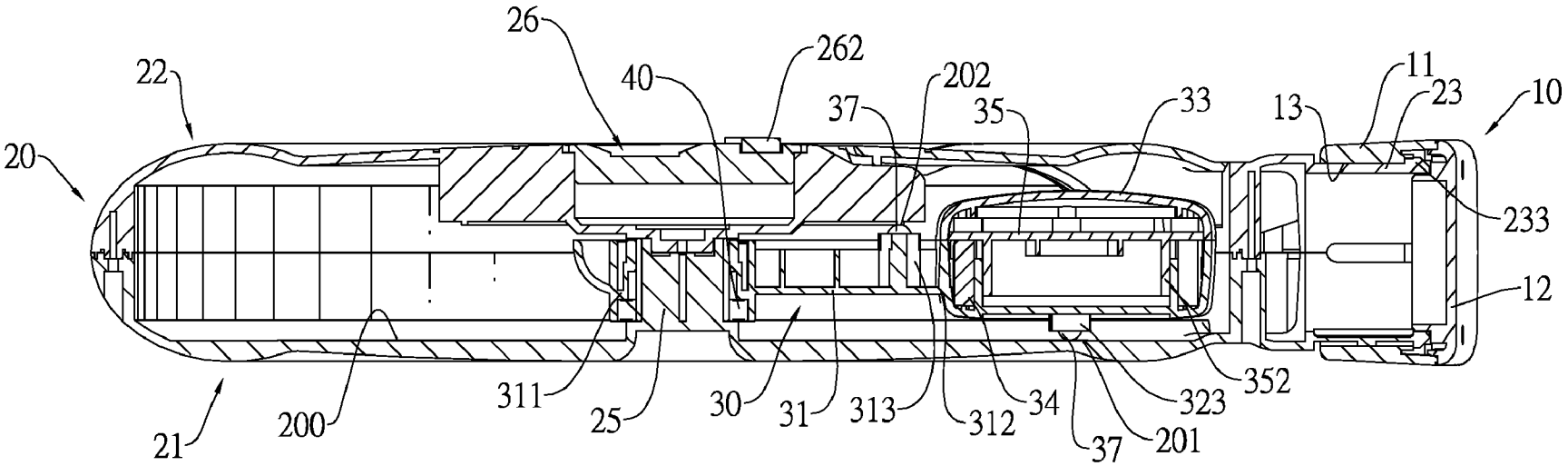
FIG. 9 is a cross sectional side view of the waist exercising device in FIG. 1.

With further reference to FIG. 9, the weight roundel (20) is mounted rotatably on the waist cushion (10) and selectively rotates on the waist cushion (10) along a radial line (X) extending radially through the weight roundel (20). The weight roundel (20) may be fabricated by a first housing (21) and a second housing (22) and has a cavity (200) and a pivot shaft (25) and may further have a pivot pin (23), a control panel (26) and a cover (27). The first and second housings (21, 22) may be transparent or translucent.

The cavity (200) is defined in the weight roundel (20), has an inner surface and may have a first circular rail (201), a second circular rail (202) and an opening. The first circular rail (201) is formed on the inner surface at the first housing (21). The second circular rail (202) is formed on the inner surface at the second housing (22). The opening is defined through the second housing (22).

The pivot shaft (25) is formed axially on the inner surface of the cavity (200) and may be formed on the first housing (21).

The pivot pin (23) is formed on and protrudes radially from the weight roundel (20), may be assembled by two semi-tubular members (231, 232) being resilient and respectively formed on the first and second housings (21, 22) and is mounted rotatably in the pivot hole (13) of the waist cushion (10). The pivot pin (23) may have a fastening hook (233) and a limiting protrusion (235). The fastening hook (233) is formed on and protrudes radially from the pivot pin (23) and hooks on the pivot mount (23). The limiting protrusion (235) is formed on and protrudes radially from the pivot mount (23) and is mounted slidably in the limiting slot (135) of the pivot mount (23) to limit the pivot pin (23) to rotate in a specific angular range, such as 90 degrees.

The control panel (26) is mounted on the second housing (22) of the weight roundel (20) and has a monitor (261), multiple keys (262), a control circuit, a central process unit and a counter. Therefore, the exerciser may manipulate the control panel (26) to implement number-count and speed-count functions.

The cover (27) is mounted pivotally on the second housing (22) of the weight roundel (20) and selectively covers the opening of the cavity (200).

Figure 4:
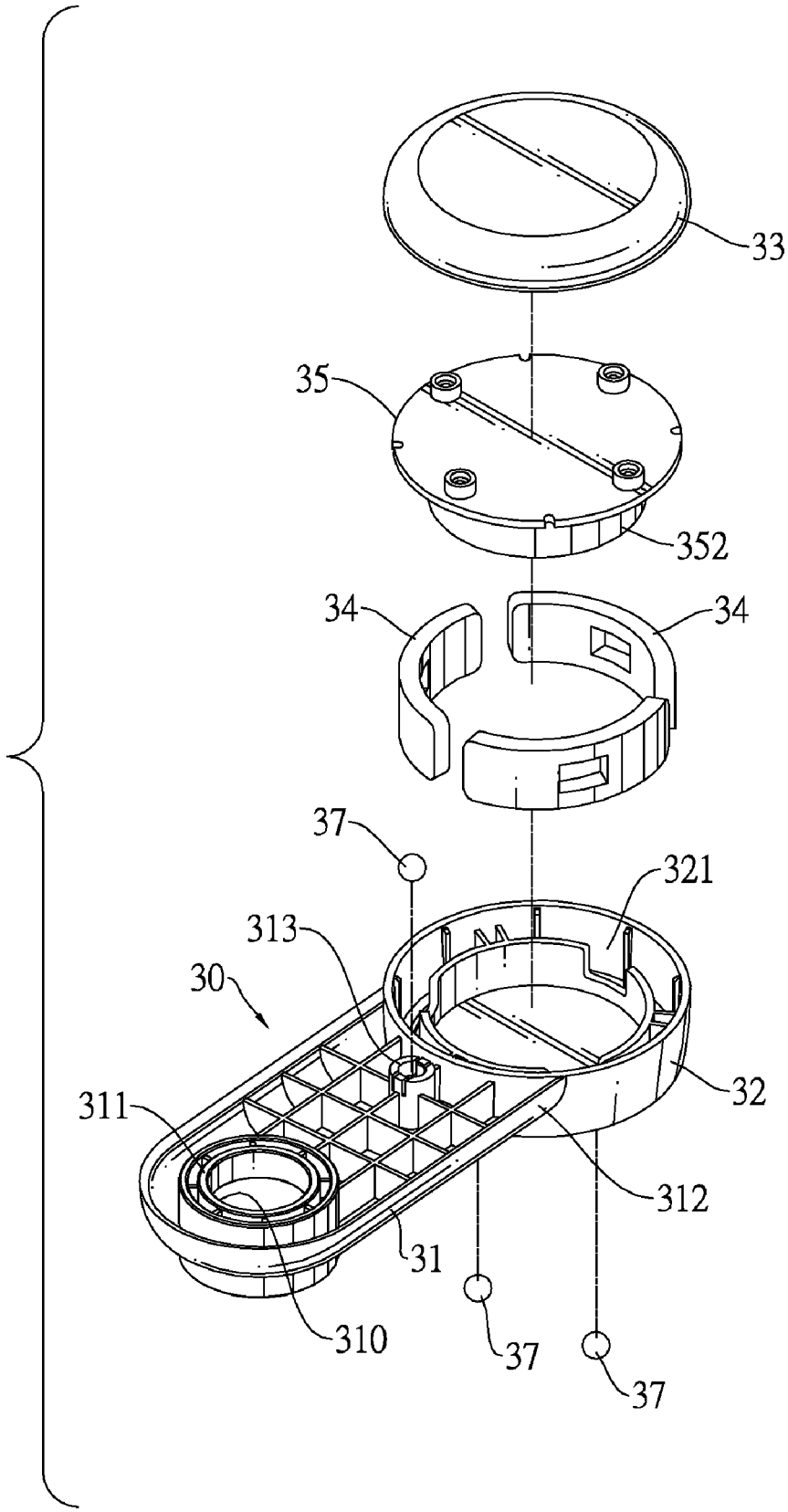
FIG. 4 is an enlarged and exploded top perspective view of a centrifugal weight assembly of the waist exercising device in FIG. 3.
Figure 5:
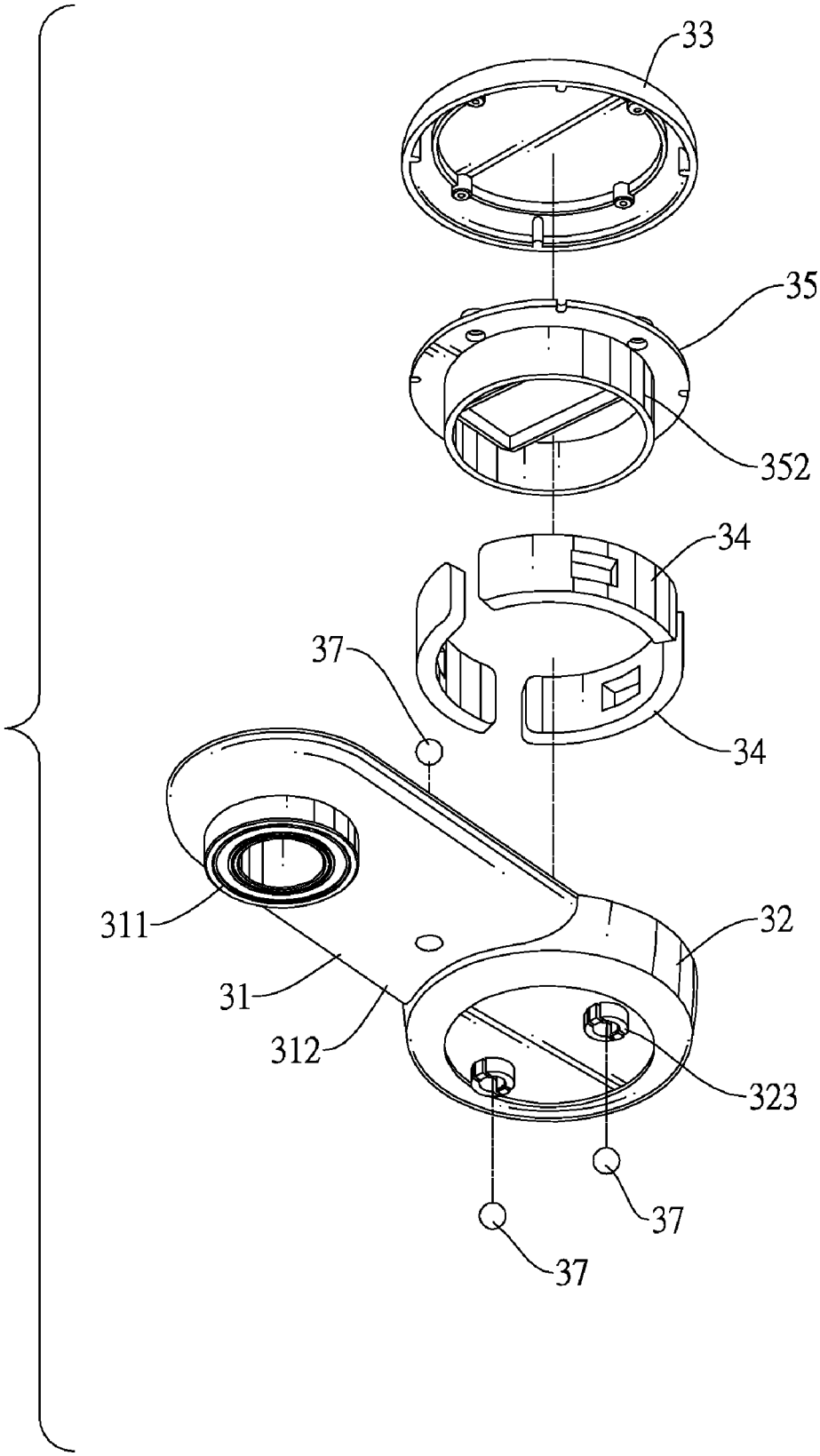
FIG. 5 is an enlarged and exploded bottom perspective view of the centrifugal weight assembly of the waist exercising device in FIG. 4.

With further reference to FIGS. 4 and 5, the centrifugal weight assembly (30) is mounted pivotally in the cavity (200) of the weight roundel (20) and has an arm (31) and a weight.

The arm (31) is mounted pivotally on the shaft (25) in the cavity (200) of the weight roundel (20), has a mounting end (311) and a connecting end (312) and may further have at least one recess (313) and at least one roller (37). The mounting end (311) of the arm (31) is mounted pivotally on the pivot shaft (25) and may have a through hole (310) and a bearing (40). The through hole (310) is defined through the mounting end (311) and mounted rotatably around the pivot shaft (25). The bearing (40) is mounted in the through hole (310) and is mounted around the pivot shaft (25) to facilitate the arm (31) pivoting on the pivot shaft (25). The connecting end (312) is opposite to the mounting end (311). The at least one recess (313) is defined in the arm (31). The at least one roller (37) may be at least one ball, is rotatably mounted respectively in the at least one recess (313) and selectively contacts the second circular rail (202) on the inner surface of the cavity (200) of the weight roundel (20). The centrifugal weight assembly (30) pivoting and slightly vibrating in the weight roundel (20) contacts the inner surface of the cavity (200) through the at least one roller (37). Therefore, the inner surface of the cavity (200) provides a counterforce supporting the arm (31) through the at least one roller (37) to ease a torsion applied to the pivot shaft (25) and facilitate the arm (31) pivoting on the pivot shaft (25).

The weight is connected to the connecting end (312) of the arm (31), selectively moves around the pivot shaft (25) to provide centrifugal force and may have a casing (32), at least one weight element (34), a lid (33) and a light assembly (35).

The casing (32) is connected to the connecting end (312) of the arm (31) and has a chamber, at least one recess (323) and at least one roller (37). The chamber is defined in the casing (32) and has at least one positioning slot (321) being curved. The at least one recess (323) is defined in the casing (32). The at least one roller (37) may be at least one ball, is rotatably mounted respectively in the at least one recess (323) of the casing (32) and selectively contacts the first circular rail (201) on the inner surface of the cavity (200) of the weight roundel (20). The inner surface of the cavity (200) provides a counterforce through the at least one roller (37) of the casing (32) to support the casing (32) to facilitate the weight moving in the cavity (200).

The at least one weight element (34) may be curved, is detachably mounted respectively in the at least one positioning slot (321) of the chamber of the casing (32). The exerciser may adjust an exercising load of the waist exercising device by simply increasing or decreasing weight elements (34).

The lid (33) detachably covers the chamber and may be transparent or translucent.

The light assembly (35) is mounted under the lid (33) and has light elements such as light-emitting diodes and a battery box (352) connected to the light elements.

Figure 10:
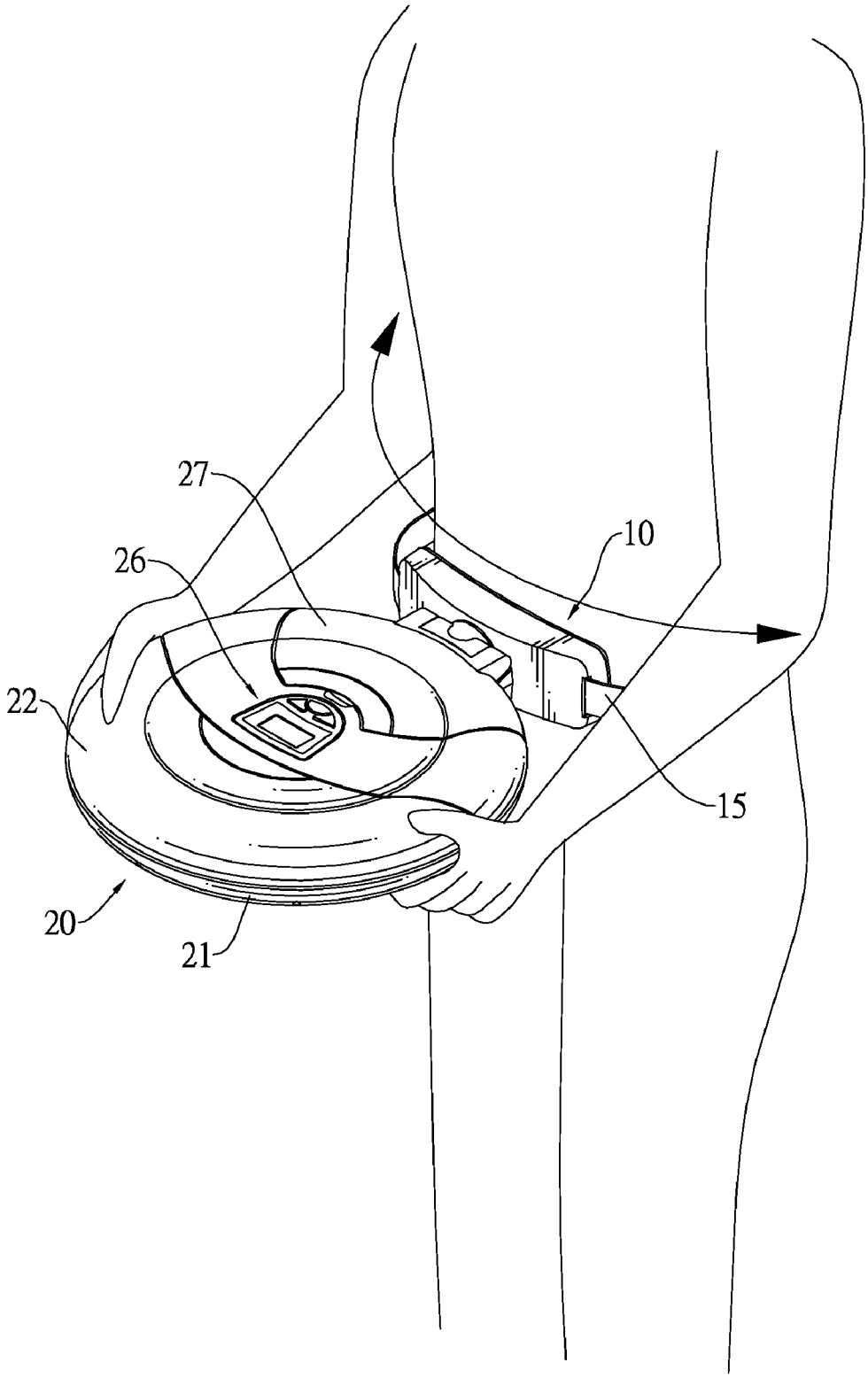
FIG. 10 is an operational perspective view of an exerciser using the waist exercising device in FIG. 1.

With further reference to FIGS. 7 and 10, in use, the waist cushion (10) is placed against a front of the abdomen and the weight roundel (20) is gripped horizontally. By swaying the waist the centrifugal force is generated by the weight (34) and the casing (30) is moved allowing the exerciser to judge an amount of effort.

Figure 11:
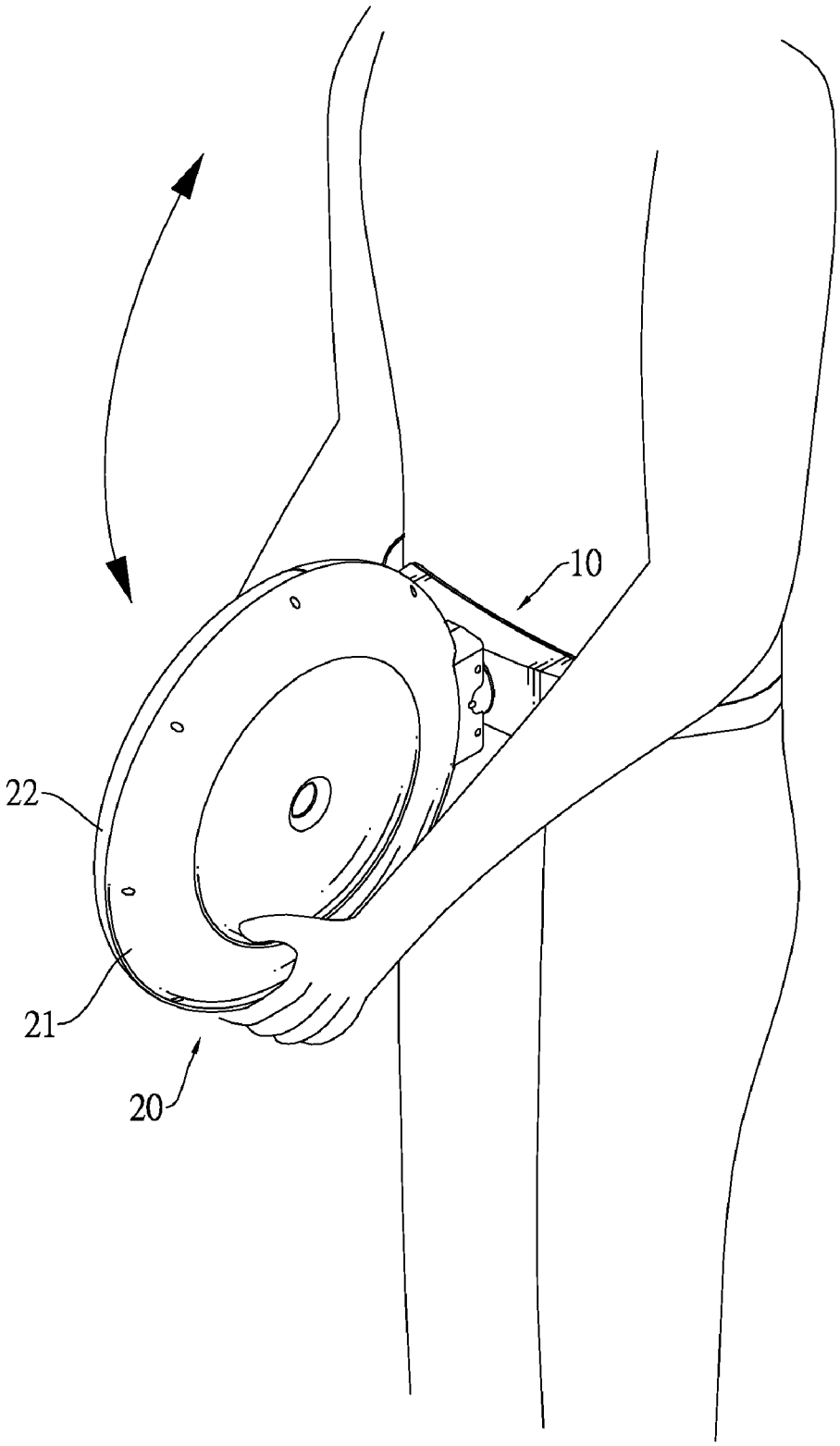
FIG. 11 is an operational perspective view of the exerciser using the waist exercising device in FIG. 2.

With further reference to FIGS. 8 and 11, the weight roundel (20) may be used in a vertical configuration and pelvic thrusts performed.

The waist exercising device has following advantages.

1. The centrifugal weight assembly (30) increases an exercise load so exercising for more efficient exercising over conventional exercise hoops.

2. The weights (34) may be increased or decreased depending on different users. A beginner may use less weights (34) and a skilled user may use more.

3. Gripping the weight roundel (20) and using the waist belt (15) prevents the waist exercising device from falling off or hitting objects or persons behind so can be used indoors more easily.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A waist exercising device comprising:

a waist cushion;

a weight roundel mounted rotatably on the waist cushion, selectively rotating on the waist cushion along a radial line extending radially through the weight roundel and having a cavity defined in the weight roundel and having an inner surface; and a pivot shaft formed axially on the inner surface of the cavity; and a centrifugal weight assembly mounted pivotally in the cavity of the weight roundel and having an arm mounted pivotally on the shaft in the cavity of the weight roundel and having a mounting end mounted pivotally on the pivot shaft; and a connecting end being opposite to the mounting end; and a weight connected to the connecting end of the arm and selectively moving around the pivot shaft.

2. The waist exercising device as claimed in claim 1, wherein the mounting end of the arm has a through hole defined through the mounting end and mounted rotatably around the pivot shaft.

3. The waist exercising device as claimed in claim 2, wherein the weight has a casing connected to the connecting end of the arm and having a chamber defined in the casing;

at least one weight element mounted detachably in the chamber; and a lid detachably covering the chamber.

4. The waist exercising device as claimed in claim 3, wherein the chamber has at least one positioning slot being curved; and the at least one weight element is curved and mounted respectively in the at least one positioning slot.

5. The waist exercising device as claimed in claim 4, wherein the cavity of the weight roundel has a first circular rail and a second circular rail formed on the inner surface;

the arm further has at least one recess defined in the arm; and at least one roller rotatably mounted respectively in the at least one recess and selectively contacting the first circular rail; and the casing further has at least one recess defined in the casing; and at least one roller rotatably mounted respectively in the at least one recess and selectively contacting the second circular rail.

6. The waist exercising device as claimed in claim 5, wherein the cavity of the weight roundel further has an opening and a cover selectively covering the opening.

7. The waist exercising device as claimed in claim 6, wherein the waist cushion has a pivot hole defined in waist cushion and having an inner surface; and the weight roundel further has a pivot pin formed on and protruding radially from the weight roundel and mounted rotatably in the pivot hole.

8. The waist exercising device as claimed in claim 7, wherein the pivot pin has a fastening hook formed on and protruding radially from the pivot pin and hooking on the waist cushion.

9. The waist exercising device as claimed in claim 8, wherein the pivot hole of the waist cushion further has a limiting slot defined in the inner surface; and the pivot pin further has a limiting protrusion formed on and protruding radially from the pivot pin and mounted slidably in the limiting slot.

10. The waist exercising device as claimed in claim 9, wherein the waist cushion has a pivot mount;

a cushion plate mounted on the pivot mount;

two mounting holes defined transversely through the pivot mount; and a waist belt is mounted through the mounting holes; and the pivot hole is defined through the pivot mount.

11. The waist exercising device as claimed in claim 10, wherein the weight roundel is assembled by a first housing and a second housing;

the opening of the cavity is defined through the second housing;

the pivot shaft is formed on the second housing; and the pivot pin is assembled by two semi-tubular members being resilient and respectively formed on the first and second housings.

* * * * *